United States Patent [19]

Shah

[11] Patent Number: 4,783,254

[45] Date of Patent: Nov. 8, 1988

[54] CYCLONE SEPARATOR MEANS

[75] Inventor: Chandulal L. Shah, Ashby-de-la-Zouch, England

[73] Assignee: Coal Industry (Patents) Limited, London, England

[21] Appl. No.: 22,205

[22] Filed: Mar. 5, 1987

Related U.S. Application Data

[62] Division of Ser. No. 786,852, Oct. 11, 1985, Pat. No. 4,735,708.

[30] Foreign Application Priority Data

Nov. 27, 1984 [GB] United Kingdom ..... 8429933

[51] Int. Cl.[4] ..... B03B 5/34

[52] U.S. Cl. ..... 209/211; 209/144

[58] Field of Search ..... 209/211, 144, 173, 155, 209/158

[56] References Cited

U.S. PATENT DOCUMENTS

| | | | |
|---|---|---|---|
| 3,477,569 | 11/1969 | Klein et al. | 209/144 |
| 4,271,010 | 6/1981 | Guarascio | 209/211 |
| 4,334,986 | 6/1982 | Frykhult | 209/211 |
| 4,602,924 | 7/1986 | Eschenburg | 209/144 |

FOREIGN PATENT DOCUMENTS

| | | | |
|---|---|---|---|
| 915561 | 6/1954 | Fed. Rep. of Germany | 209/211 |
| 2128905 | 5/1984 | United Kingdom . | |

*Primary Examiner*—Robert B. Reeves
*Assistant Examiner*—Donald Hajec
*Attorney, Agent, or Firm*—James C. Wray

[57] ABSTRACT

Cyclone separator for treating granular solid material to derive separate fractions of different densities, comprise a treatment chamber divided into first and second treatment compartments. A relatively more dense fraction of material is fed via interconnected outlet from one treatment compartment to the other treatment compartment for retreatment.

9 Claims, 10 Drawing Sheets

CYCLONE SEPARATOR MEANS

This application is a division of application Ser. No. 786,852, filed Oct. 11, 1985, now U.S. Pat. No. 4,735,708.

This invention relates to cyclone separator means for treating granular solid material.

In particular, the present invention relates to separator means for separating granular solid material into fractions of different densities.

Our prior United Kingdom patent specification No. 994 351 described apparatus for separating granular solid material of different densities, comprising two separating treatment chambers each arranged for receiving granular solid materials together with dense medium for separating the granular solid material according to density and having first discharge means for discharging less dense granular solid material together with dense medium, second discharge means for discharging relatively dense granular solid material together with dense medium, and third discharge means for discharging intermediate dense granular solid material together with dense medium. The second and third discharge means included secondary vessels for partially dissipating pressure energy of the discharges from the two treatment chambers. Thus, with previously proposed separator means having two treatment chambers a three fraction treated product was derived, the three fractions having different densities, respectively. The purpose of providing additional treatment chambers was to obtain more fractions of different densities and not to increase the efficiency of separation.

Unfortunately, with prior cyclone separator means having one or more treatment chambers each treated fraction usually contains a relatively high amount of material which should have been included in a different density fraction.

An object of the present invention is to provide improved cyclone separator means having a more efficient separation of the granular solid material into fractions of different densities.

According to the present invention cyclone separator means for treating granular solid material to derive separate fractions of different densities, the separator means comprising a treatment chamber, having at least two treatment compartments for treating and further treating material, respectively, and outlet means from the treatment chamber for a relatively more dense fraction, each component having inlet means for material to be treated or further treated, and outlet means for a treated or partially treated relatively less dense fraction, the separator means further comprising liquid medium inlet means to one of the treatment compartments, and interconnected outlet and inlet means provided on the two treatment compartments, respectively, and adapted to feed partially treated material from one treatment compartment to the other treatment compartment.

Preferably, the interconnected outlet and inlet means is adapted to feed a partially treated relatively more dense fraction from one treatment compartment to the other treatment compartment.

Preferably, the treatment chamber comprises a first treatment compartment for treating raw material and a second treatment compartment for treating partially treated material discharged from the first treatment compartment.

Conveniently, the interconnected outlet and inlet means is adapted to feed partially treated material from the second treatment compartment to the first treatment compartment.

Advantageously, the interconnected outlet and inlet means is adapted to feed a relatively more dense fraction of material from the second treatment compartment back into the first treatment compartment for retreatment.

Alternatively, the interconnected outlet and inlet means is adapted to feed partially treated material from the first treatment compartment to the second treatment compartment.

In this arrangement the interconnected means is adapted to feed a relatively more dense fraction of material from the first treatment compartment into the second treatment compartment.

The liquid medium may be adopted to feed into the second treatment compartment.

The liquid medium may be fed into the first treatment compartment.

Preferably, the effective specific density of the liquid medium is different in the two treatment compartments.

By way of example, two embodiments of the present invention will be described with reference to the accompanying drawings, in which.

Figure 1:
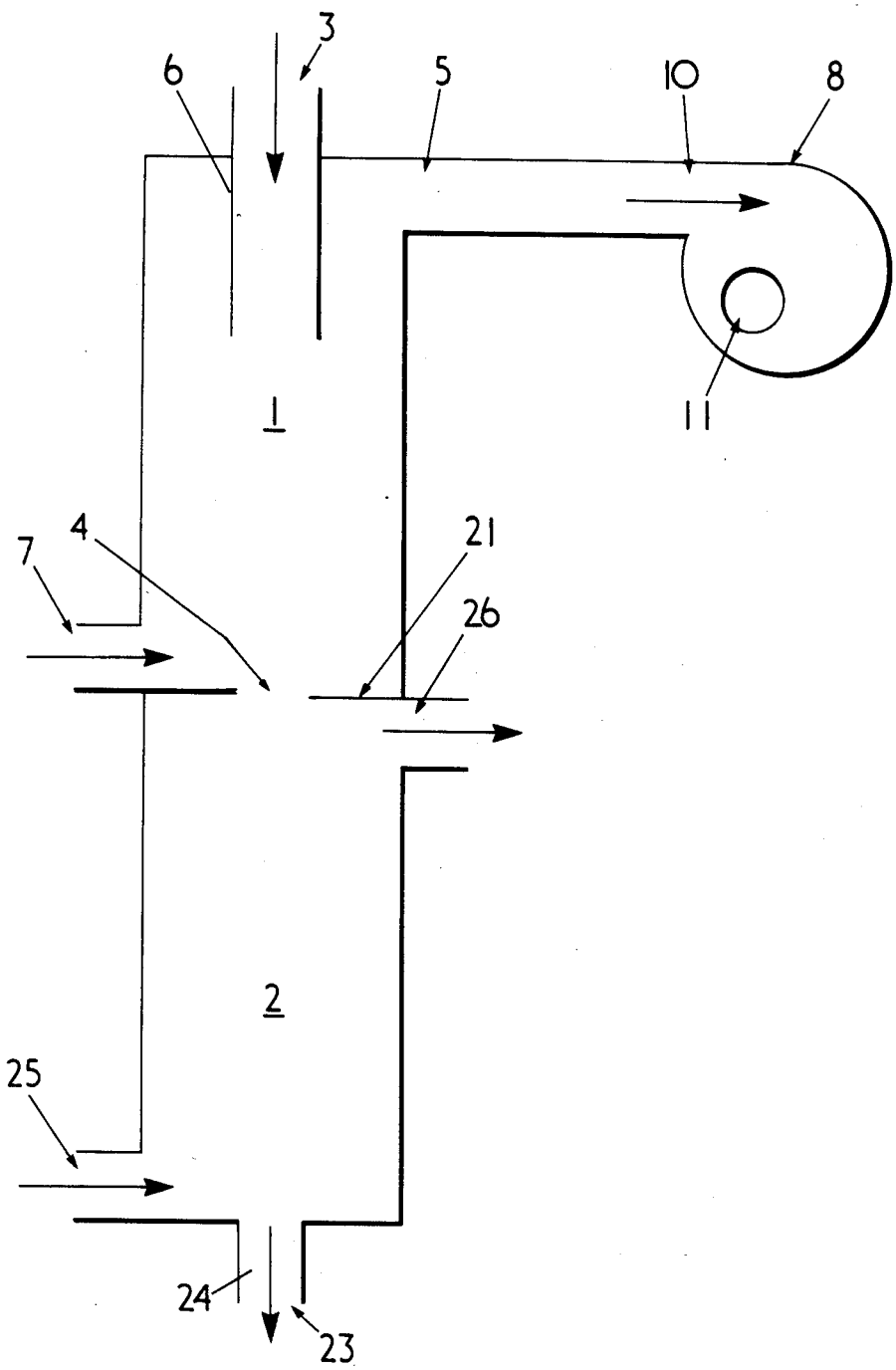
FIG. 1 is a diagrammatic side elevation of cyclone separator means having a treatment chamber and constructed in accordance with a first embodiment of the present invention and shown in an operational mode.
Figure 2:
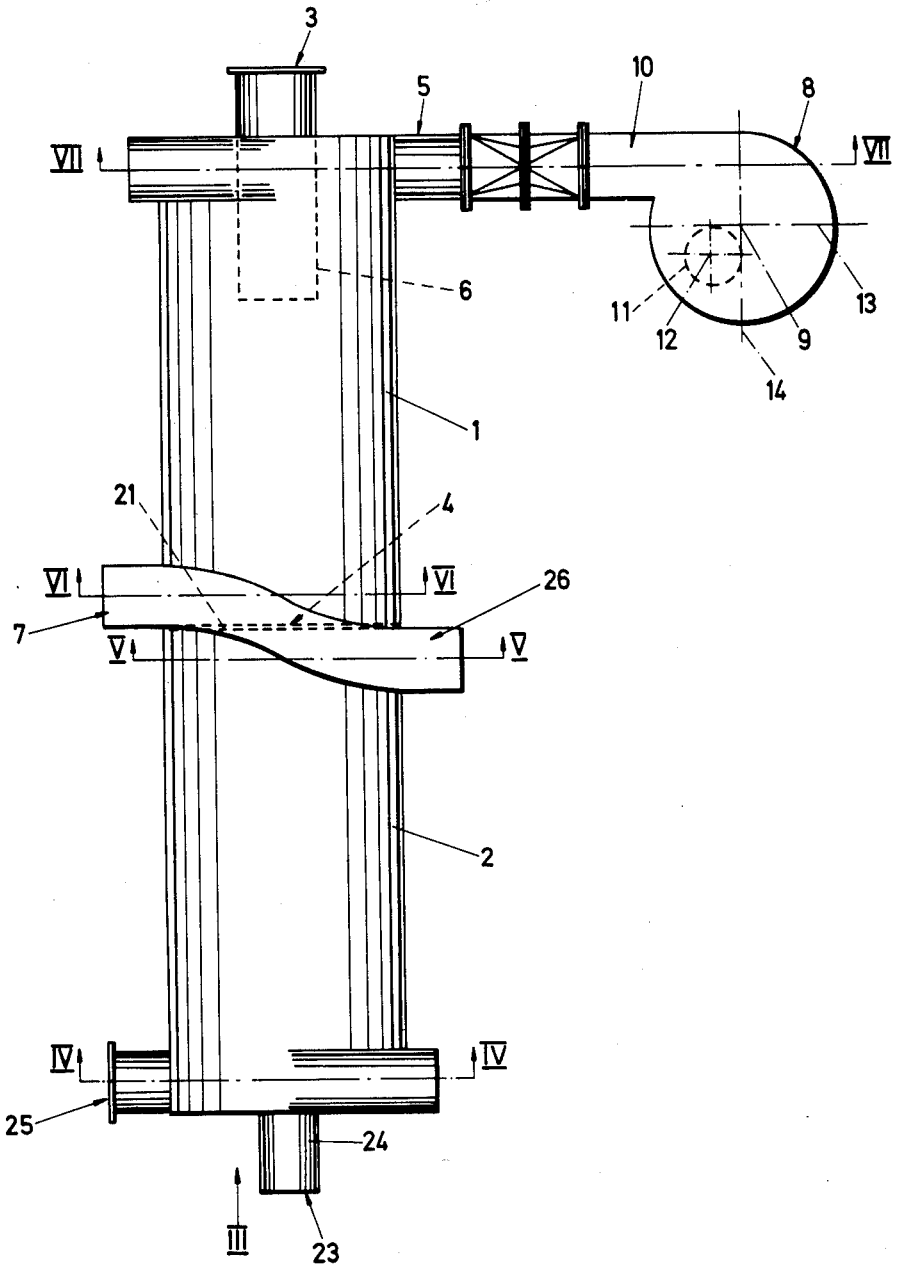
FIG. 2 is a plan of the cyclone separator means of FIG. 1 and drawn on an enlarged scale.
Figure 3:
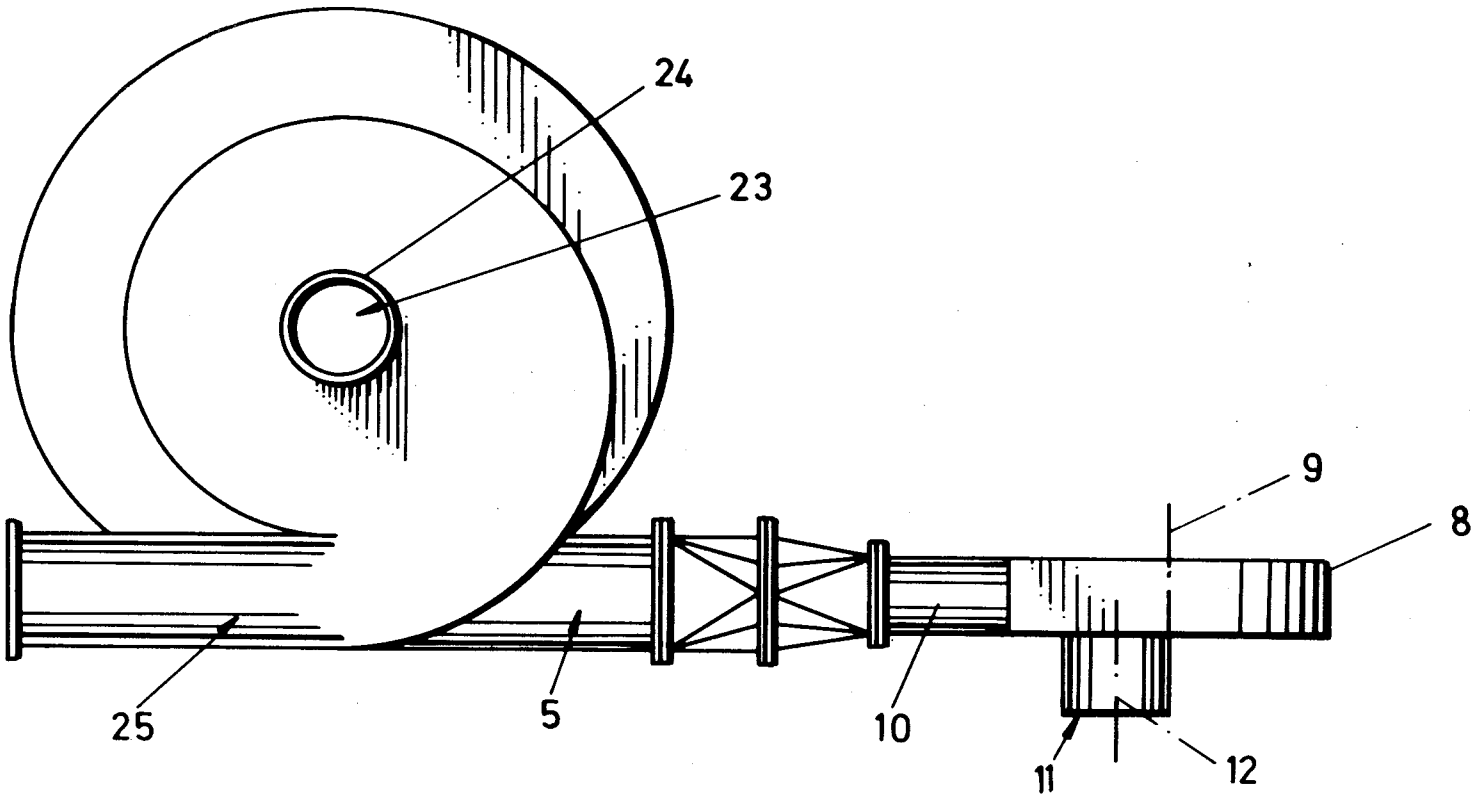
FIG. 3 is an end view looking in the direction of arrow III in FIG. 2.
Figure 4:
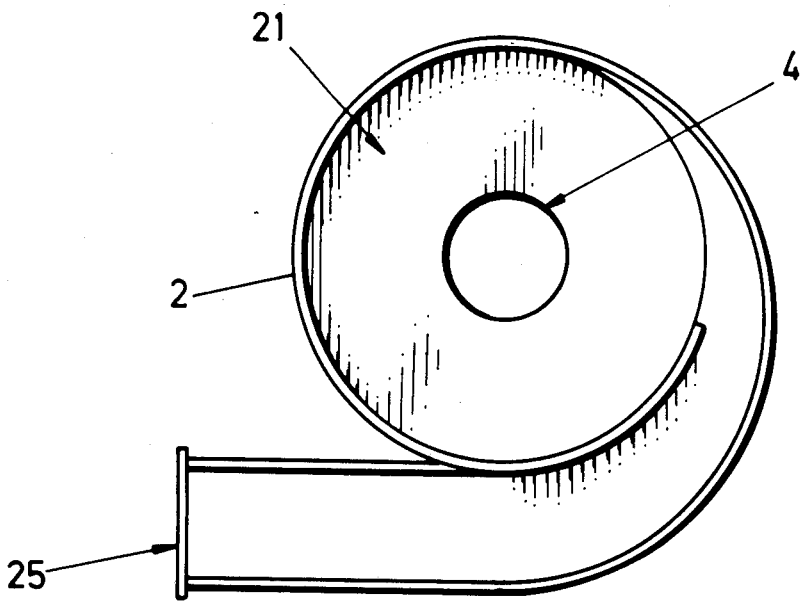
FIGS. 4 to 7 are incomplete cross-sectional views taken along section lines IV, V, VI and VII of FIG. 2, respectively.
Figure 5:
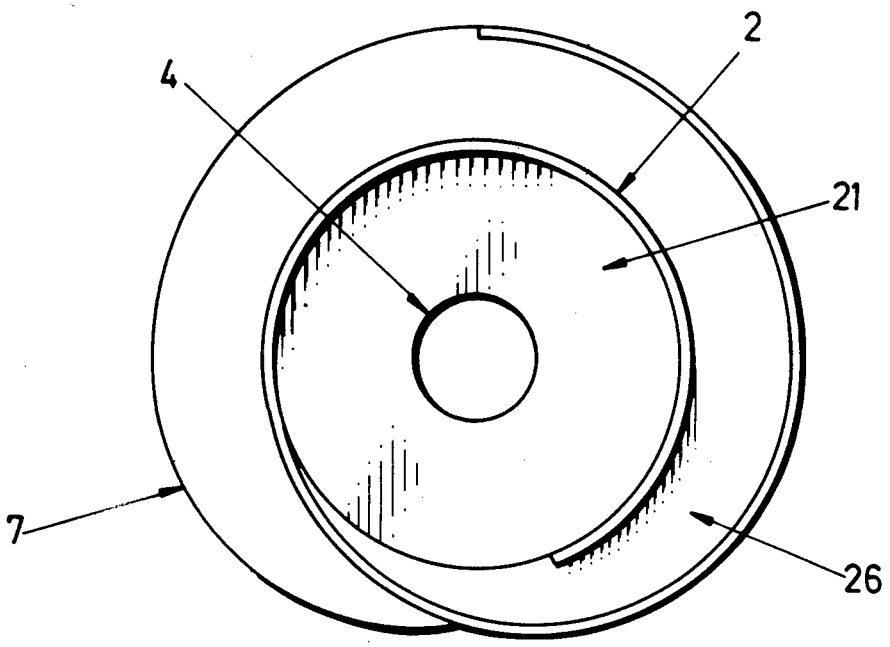
Figure 6:
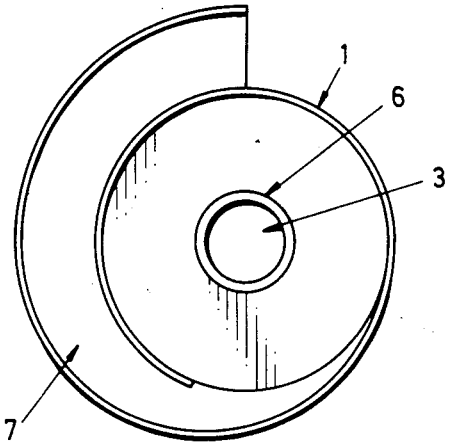
Figure 7:
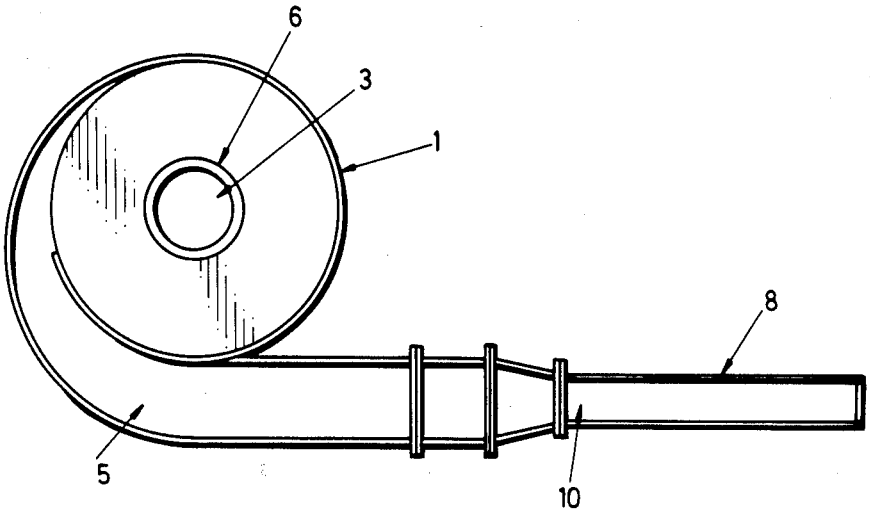
Figure 8:
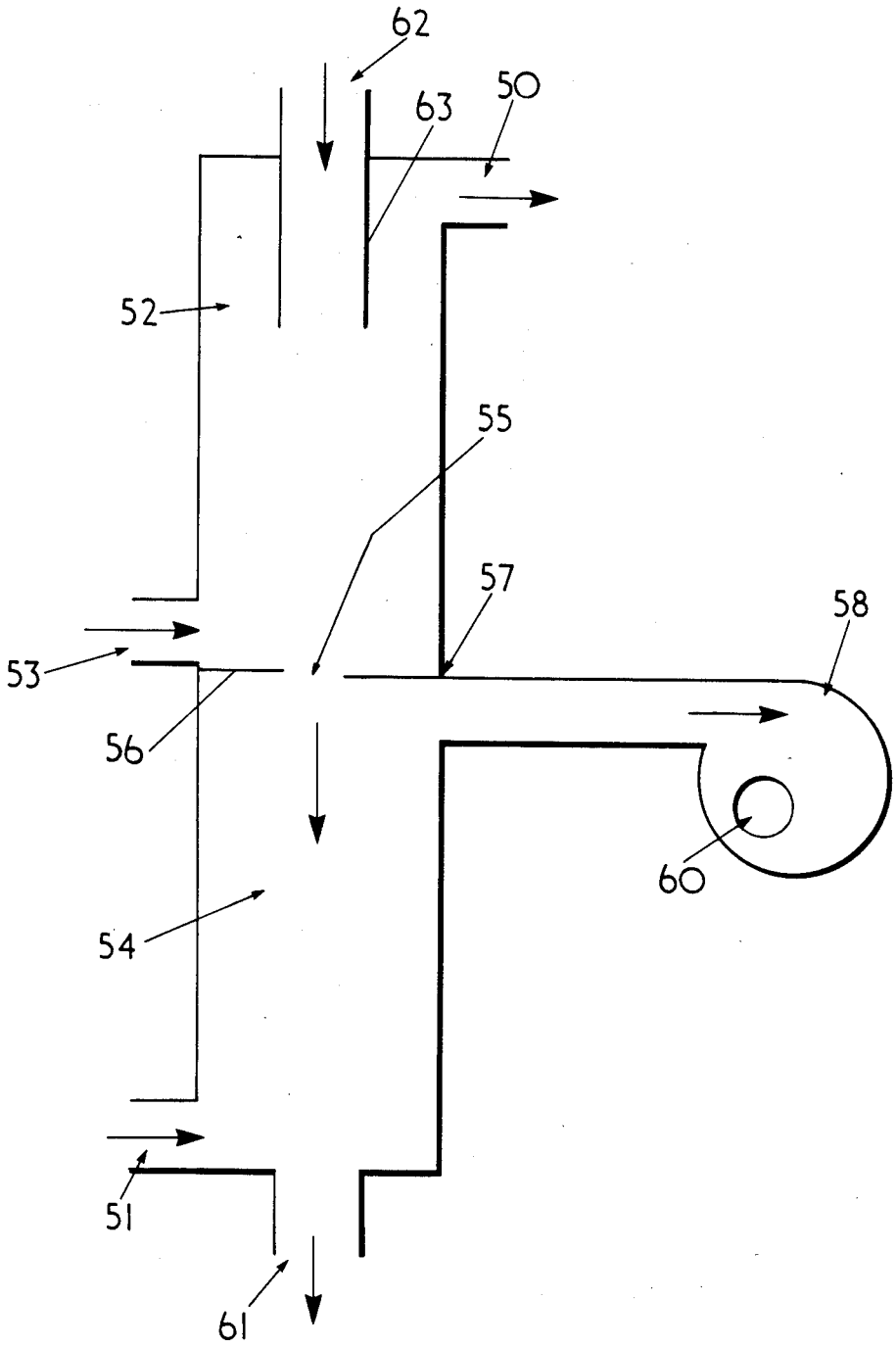
FIG. 8 is a diagrammatic side elevation of cyclone separator means having a treatment chamber and constructed in accordance with a second embodiment of the present invention and shown in an operational mode.
Figure 9:
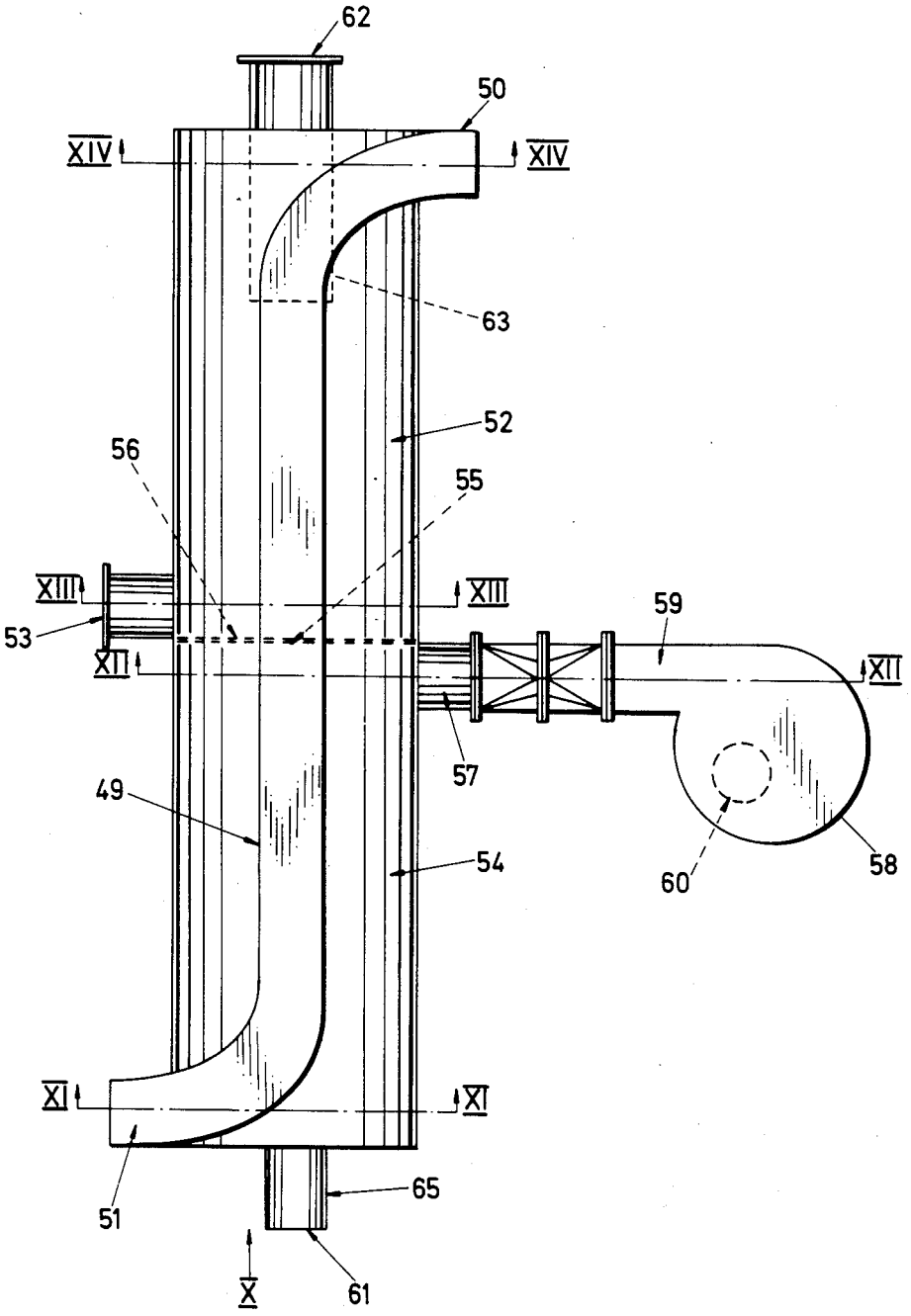
FIG. 9 is a plan of the cyclone separator means of FIG. 8 and drawn on an enlarged scale.
Figure 10:
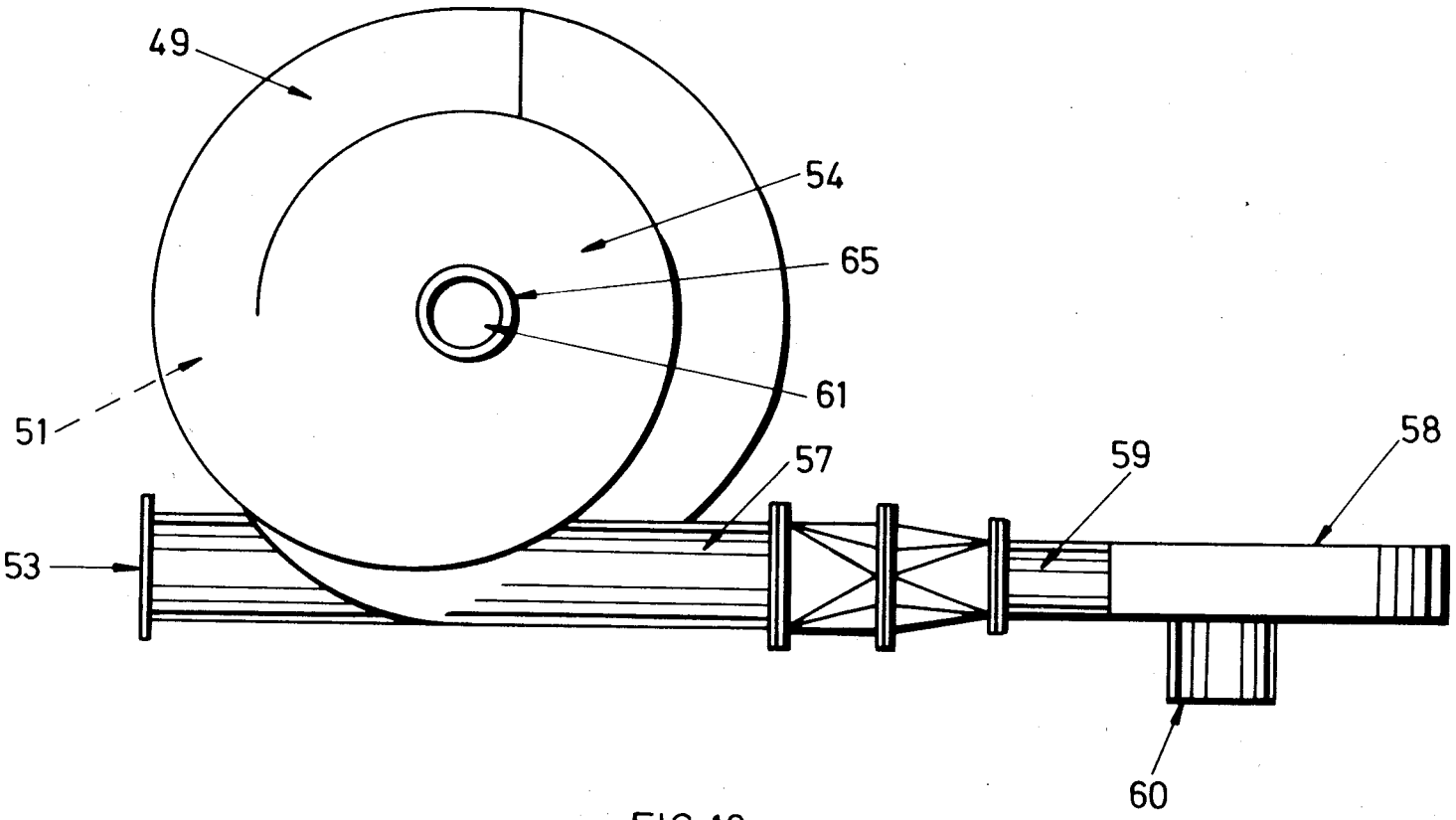
FIG. 10 is an end view looking in the direction of arrow X in FIG. 9.
Figure 11:
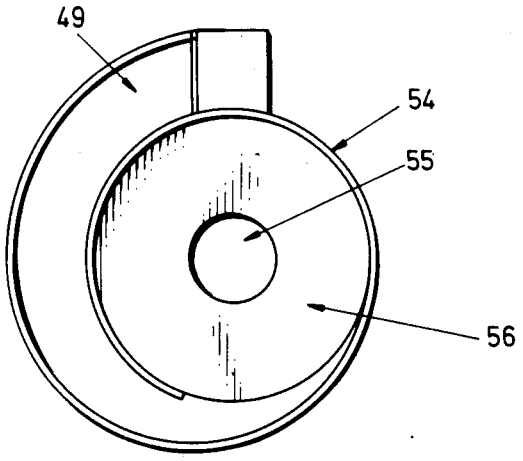
FIG. 11 to 14 are incomplete cross-sectional views taken along section lines XI, XII, XIII and XIV of FIG. 9, respectively.
Figure 12:
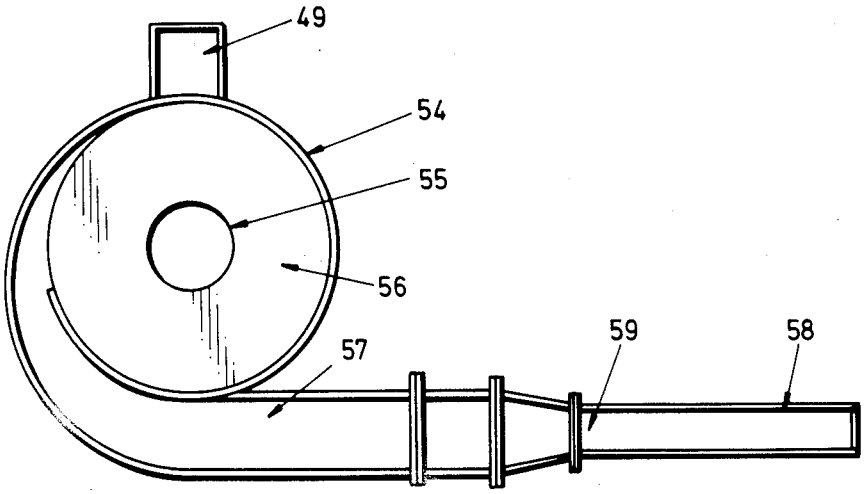
Figure 13:
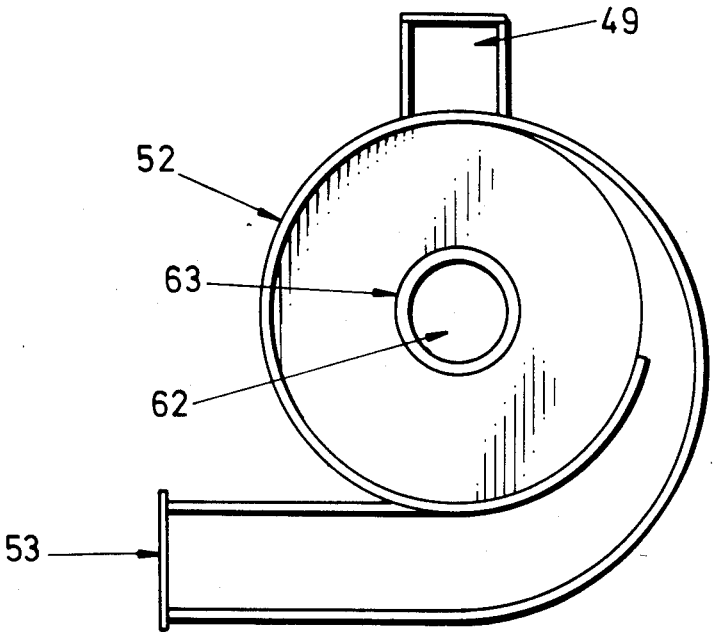
Figure 14:
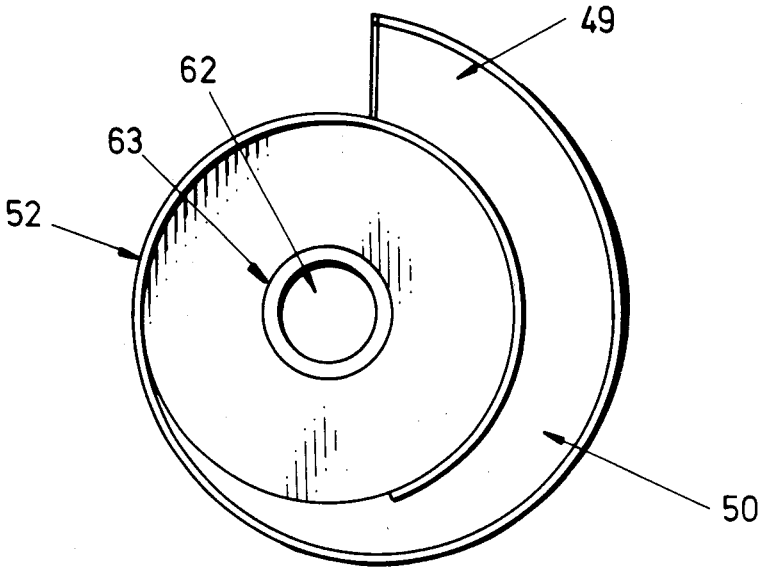

The first embodiment of cyclone separator means as disclosed in FIGS. 1 to 7, is suitable for treating granular solid material (as for example raw coal) to derive separate fractions of different densities. The separator means comprises a single treatment chamber divided by a cross plate 21 into two treatment compartments 1 and 2 for treating and further treating material, respectively. The treatment compartment 1 is provided with an axial inlet 3 for raw material to be treated and an axial outlet 4 for the partially treated relatively less dense fraction. As seen in FIG. 2 the outlet 4 is of smaller diameter than the inlet 3 in order to control the flow through the treatment compartment and to ensure the relatively more dense fraction is discharged via a tangential outlet 5 provided at the end of the treatment compartment adjacent to the inlet 3.

As seen in FIGS. 1 and 2 the inlet 3 has an inlet pipe 6 extending into the compartment to segregate the infeed from the material being discharged via outlet 5.

Also the outlet 4 comprises an aperture or throat formed in the crossplate 21. The treatment compartment 1 also comprises a tangential inlet 7 the purpose for which will be made clearer later in this specification.

The outlet 5 comprises a generally cylindrical secondary vessel 8 having a generally circular cross-section arranged co-axial with the longitudinal axis 9 of the secondary vessel. The secondary vessel has an inlet 10 connected to receive relatively more dense solid material together with dense medium discharging from the treatment compartment 1, the inlet 10 being tangentially arranged with respect to said longitudinal axis 9. An outlet 11 for the discharge of the relatively more dense material together with dense medium from the secondary vessel 8 is provided in an end wall of the generally cylindrical vessel, as seen in FIG. 2 the axis 12 of the outlet 11 is radially displaced from the longitudinal axis 9. Also as seen in FIG. 2 the outlet 11 is circular and the two mutually perpendicular centre lines 13 and 14 intersecting at the axis 9 and being parallel to the tangential inlet 10 and normal to the inlet 10, respectively, are targets to the outer boundary of the circular outlet. The outlet axis 12 is on the side of the centre line 13 remote from the tangential inlet 10 and on the same side of the centre line 14 as the inlet 10.

The second treatment compartment 2 has an axial inlet constituted by the aperture or throat 4 for the relatively less dense material discharged from treatment compartment 1. Upon entering treatment compartment 2 there is no hindrance to flow. The second treatment compartment also comprises an axial outlet 23 for the fully treated less dense fraction of the solid material, the outlet pipe 24 defining the outlet 23 being of smaller diameter than the inlet 3 in order to control the flow through the treatment chamber. The treatment compartment 2 is provided with a tangential inlet 25 for pressurised liquid medium typically a dense medium of a desired preselected relative density as for example, an organic liquid or a finely ground solid/liquid suspension, and a tangential outlet 26 for the relatively more dense fraction of the material entering the second treatment compartment. The tangential outlet 26 is directly interconnected with the aforementioned tangential inlet 7, the interconnection of the outlet 26 to the inlet 7 feeds dense medium together with the relatively more dense fraction of the material entering the second treatment compartment 2 back into the first treatment compartment 1 where it is retreated. This retreatment gives the cyclone means a second chance to re-classify material discharged from the second treatment compartment 2 via outlet 26. This re-classification tends to improve the separation efficiency of the cyclone means when compared to the prior known single treatment chamber cyclone comprising only a single treatment compartment.

In operation, dense medium is introduced continuously into the second treatment compartment 2 via the tangential inlet 25. From the second compartment some dense medium is discharged via axial outlet 23 and the remainder is discharged via tangential outlet 26 and fed into the first treatment compartment 1 via tangential inlet 7. From compartment 1 some dense medium is discharged back into the second compartment via outlet 4, the remainder is discharged via tangential outlet 5 into the secondary vessel 8 where the pressure energy of the rapidly moving medium flow is partially dissipated. All the medium flow via outlet 5 is discharged via outlet 11 of the secondary vessel.

Untreated granular solid material as for example, raw coal is fed into the uppermost axial inlet 3, (usually the longitudinal axis of the treatment chamber is inclined at 1020 to 45° to the horizontal although in some installations the axis is horizontal or possible vertical). The size of raw coal fed into the cyclone separator means will depend upon the physical size of the treatment chamber.

Upon entering the first treatment compartment 1 the raw coal is swept along by the rapidly moving dense medium flowing around the compartment, the centrifugal action of the flow inducing relatively more dense material (i.e. the reject) to move to the radially outer regions of the treatment compartment from where it passes towards the tangential outlet 5 and thence to the secondary vessel 8 to be discharged through outlet 11.

The relatively less dense material in compartment 1 tends to be retained adjacent the radially innermost region of the compartment and is passed towards the axial outlet 4. Upon passing through the outlet 4 the material enters the second treatment compartment 2. Once again this material is subjected to centrifugal action because of the dense medium flow and the relatively more dense material is induced to move to the radially outermost regions of the compartment 2 and thence to the tangential outlet 26. As the outlet 26 is directly interconnected to the tangential inlet 7 of the first treatment compartment 1 the discharge through outlet 26 is fed directly into the compartment 1 where the infeed provides the source of dense medium to the treatment compartment and where the relatively dense fraction discharged through outlet 26 is retreated. As a result of the way in which the classification of a solid/-liquid suspension (i.e. dense medium) takes place in a cyclone separator, the medium discharged via outlet 26 will be of higher relative density than the medium introduced via inlet 25. Hence, the separation in compartment 1 tends to occur at a higher relative density than that in compartment 2.

The retreatment of the material discharging through outlet 26 gives the material a second chance to be reclassified. Consequently, the discharge of clean coal via outlet 23 tends to contain a less proportion of reject when compared with prior known single treatment systems comprising a single treatment chamber. The major advantage of the present cyclone separator means is that it is possible to retreat material in the near gravity range (i.e. material slightly lighter or heavier than the separation density) in the same equipment and without requirement of additional medium.

Referring now to FIGS. 8 to 14 which show a second embodiment of the invention according to the present invention.

The construction of the second embodiment is similar to the first described embodiment except that a longitudinal passage 49 interconnects a tangential outlet 50 with a tangential inlet 51. The longitudinal axis of the treatment chamber is inclined at 10° to 45° to the horizontal although in some installations it may be horizontal and possibly vertical.

With the second embodiment dense medium is fed into a first treatment compartment 52 via a tangential inlet 53. From the first compartment a portion of the dense medium is discharged via the aforementioned tangential outlet 50 and along the passage 49 to enter a second treatment compartment 54 via tangential inlet 51. Another portion of the dense medium is discharged from the first treatment compartment via axial outlet 55 and thence enters the second treatment compartment 54 via axial inlet constituted by outlet 55 in the form of an aperture or throat provided in cross plate 56 dividing the treatment chamber.

From the second treatment compartment dense medium is discharged via a tangential outlet 57 to a secondary vessel 58 having a tangential inlet 59 and an axial outlet 60. The construction of the secondary vessel is as for vessel 8 of the previously described embodiment. Dense medium also is discharged from the second treatment compartment 54 via axial outlet 61.

Untreated granular solid material (as for example, raw coal) is introduced into the first treatment compartment 52 via an axial inlet 62 and as with the previously described embodiment the relatively dense material tends to be urged towards the radially outermost regions of the compartment 52 and thence towards the tangential outlet 50. This material is introduced into the second treatment compartment 54 via tangential inlet 51. The relatively less dense material is discharged from the first treatment compartment 52 via axial outlet 55.

Upon intering the second treatment compartment via inlets 51 and 55 the material is again subject to centrifugal motion with the relatively more dense material (i.e. the reject) tending to move towards the radially outermost regions of the compartment to be discharged via outlet 57 and thence via outlet 60 of the secondary vessel 58. The relatively less dense material (i.e. the clean coal) tends to be retained in the radially innermost portion and is discharged via axial outlet 61.

An inwardly extending buide tube 53 is provided at the axial inlet 62.

A particular advantage of the second embodiment of separator according to the invention is that it is possible for both the heavy and light fractions to go through a second refinement separation in the single set of equipment without requirement of additional medium. Any near gravity material that is misplaced in the first separation gets a second chance to be correctly placed. As a result of the way in which the classification of solid/liquid suspension (i.e. the dense medium) takes place in a single chamber separator, the medium which now bears the heavy fraction discharged via outlet 50 will be of a higher relative density than the medium introduced via inlet 53. Thus, the separation in compartment 54 takes place at a higher relative density than in compartment 52. By the time the lighter and heavy material enters the compartment 54 most of the products are correctly placed to go out to their respective outlets. Therefore, the compartment 54 deals mainly with the misplaced rear gravity material. The cyclone separator according to the invention therefore tends to be more efficient than conventional cyclone separators including a single treatment compartment.

In other embodiments of the present invention the treatment chamber is divided into more than two treatment compartments, some fractions of the material being retreated more than once.

I claim:

1. Cyclone separator means for treating granular solid material to derive separate fractions of different densities, comprising a treatment chamber having at least two treatment compartments for treating and further treating material, respectively, and outlet means from the treatment chamber for a relatively more dense fraction, each compartment having inlet means for material to be treated, and outlet means; the outlet means of a first compartment of said at least two compartments being for a partially treated relatively less dense fraction, and the outlet means of a second compartment being for a treated relatively less dense fraction, the outlet means for said partially treated relatively less dense fraction of said first compartment being interconnected with the inlet means for said second compartment for feeding the partially treated material from the first treatment compartment to the second treatment compartment, the separator means further comprising liquid medium inlet means connected to one of the treatment compartments the second treatment compartment having a dense fraction outlet means for the liquid medium carrying a relatively more dense fraction from the second treatment compartment and said dense fraction outlet means being interconnected with a second inlet means in the first treatment compartment so as to further treat the relatively more dense fraction from the second treatment compartment.

2. Cyclone separator means for treating granular solid material to derive separate fractions of different densities, comprising a treatment chamber divided by an apertured plate to form at least two treatment compartments for treating and further treating material, respectively, and each compartment having tangentially disposed outlet means from the treatment chamber for a relatively more dense fraction, the first compartment having tubular first inlet means for material to be treated, tangentially disposed second inlet means and axial outlet means comprised by the apertured plate for passing treated and partially treated relatively less dense fractions to the second compartment, the second compartment further including a liquid treatment medium inlet means, the tangentially disposed outlet means from the second compartment being connected via interconnecting means to the tangentially disposed second inlet means of the first compartment so as, in operation, to feed treatment medium and material removed from the treated material from the second treatment compartment to the first treatment compartment for further treatment.

3. Cyclone separator means as claimed in claim 2, in which the interconnected outlet and inlet means feed a partially treated relatively more dense fraction from the second treatment compartment to the first treatment compartment.

4. Cyclone separator means as claimed in claim 3, wherein the at least two treatment compartments comprise a first treatment compartment for treating raw material and a second treatment compartment for treating partially treated material discharged from the first treatment compartment.

5. Cyclone separator means as claimed in claim 2, wherein liquid medium is fed first into the second treatment compartment.

6. Cyclone separator means as claimed in claim 2, in which the effective specific density of a separating medium is different in the two treatment compartments.

7. Cyclone separator means as claimed in claim 2, in which the means interconnecting the first and second compartments are external of the treatment chambers.

8. Cyclone separator means for treating granular solid material to derive separate fractions of different densities, comprising a single treatment chamber divided by a crossplate into at least two treatment compartments for treating and further treating material, respectively, a first treatment compartment having an axial inlet means for raw material to be treated and an axial outlet means for feeding a partially treated, relatively less dense fraction into a second treatment compartment, the first treatment compartment further having a tangential outlet means adjacent to the axial inlet means for discharging a relatively more dense fraction, the second treatment compartment having an axial inlet means for the relatively less dense material discharged through the axial outlet means of the first treatment compartment, said crossplate provided with an aperture forming the axial outlet means of the first compartment and the axial inlet means of the second compartment an axial outlet means for a fully treated, less dense fraction, a tangential inlet means for a liquid treatment medium, a tangential outlet means interconnected with a tangential inlet means of the first treatment compartment for feeding the treatment medium and a relatively more dense fraction of the material entering the second treatment compartment means back into the first treatment compartment for retreatment.

9. Cyclone separator apparatus for treating granular solid material to derive separate fractions of different densities comprising, a generally cylindrical treatment chamber having first and second ends and having a central crossplate dividing the chamber into first and second treatment compartments, an opening in the first end comprising an inlet opening for material to be treated, a central aperture in the crossplate for providing an outlet for the first compartment and an inlet for the second compartment for partially treated material, and an opening in the second end for providing an outlet from the second compartment for treated material, a first treatment medium inlet means tangentially connected to the chamber near the second end and a first liquid medium outlet means tangentially connected to the second compartment near the crossplate, a second treatment medium inlet means tangentially connected to the first compartment near the crossplate and a second treatment medium outlet means tangentially connected to the first compartment near an upper end and treatment medium conduit means connecting the first treatment medium outlet means to the second treatment medium inlet means, whereby material to be treated flows through the first compartment and then through the second compartment and less dense components flow out through the opening in the second end and whereby the treatment medium flows in through the first inlet means, swirls around the inside of the second compartment gathering relatively dense components from the partially treated material to be treated, and swirls out through the first liquid medium outlet carrying the dense components of the partially treated material and flows with the dense components separated from the partially treated material into the second treatment medium inlet and swirls with the dense components retreating the dense components from the second compartment, gathering other dense components of the material to be treated in the first treatment compartment and then swirls out of the first treatment compartment with the dense components of the material to be treated through the second treatment medium outlet.

* * * * *